US008459818B2

(12) United States Patent
Becke et al.

(10) Patent No.: US 8,459,818 B2
(45) Date of Patent: Jun. 11, 2013

(54) REFRIGERATION APPLIANCE BODY COMPRISING INTERNAL LIGHTING

(76) Inventors: Christoph Becke, Grosskarolinenfeld (DE); Max Eicher, München (DE); Sebastian Knöll, München (DE); Tobias Schmidt, München (DE); Ralph Staud, München (DE); Thomas Tischer, Haar (DE); Matthias Wiedenmann, Neenstetten (DE)

( * ) Notice: Subject to any disclaimer, the term of this patent is extended or adjusted under 35 U.S.C. 154(b) by 127 days.

(21) Appl. No.: 13/130,313

(22) PCT Filed: Nov. 13, 2009

(86) PCT No.: PCT/EP2009/065137

§ 371 (c)(1),
(2), (4) Date: Jun. 16, 2011

(87) PCT Pub. No.: WO2010/063553

PCT Pub. Date: Jun. 10, 2010

(65) Prior Publication Data

US 2011/0277493 A1 Nov. 17, 2011

(30) Foreign Application Priority Data

Dec. 3, 2008 (DE) ..... 10 2008 044 302

(51) Int. Cl.
*F21V 33/00* (2006.01)

(52) U.S. Cl.
USPC ..... 362/92; 362/154

(58) Field of Classification Search
USPC ..... 362/92, 126, 154; 312/116; 62/264
See application file for complete search history.

(56) References Cited

U.S. PATENT DOCUMENTS

| | | | | |
|---|---|---|---|---|
| 2,995,649 | A * | 8/1961 | Cyrus | 362/92 |
| 7,736,010 | B2 * | 6/2010 | Lee | 362/92 |
| 7,905,614 | B2 * | 3/2011 | Aoki | 362/92 |
| 2008/0247154 | A1 * | 10/2008 | Lim et al. | 362/92 |
| 2009/0056360 | A1 | 3/2009 | Krauss | |
| 2010/0220460 | A1 * | 9/2010 | Hall | 362/92 |

FOREIGN PATENT DOCUMENTS

| | | | |
|---|---|---|---|
| CN | 1143741 | A | 2/1997 |
| CN | 2926950 | Y | 7/2007 |
| EP | 0971186 | B1 | 8/2003 |
| JP | 2006336985 | A | 12/2006 |
| JP | 2008039359 | A | 2/2008 |
| JP | 2008070080 | A | 3/2008 |
| JP | 2008073153 | A | 4/2008 |
| JP | 2009115407 | A | 5/2009 |

OTHER PUBLICATIONS

International Search Report PCT/EP2009/065137.
Report of Examination including National Search Report CN 200980148767.6 mailing date Jan. 14, 2013.

* cited by examiner

*Primary Examiner* — Laura Tso
(74) *Attorney, Agent, or Firm* — James E. Howard; Andre Pallapies

(57) ABSTRACT

A refrigeration appliance includes a body having walls to define an interior with an open front side. One of the walls extends from the front side of the body in a depth direction and is formed with at least one recess. A translucent pane seals the at least one recess and is at least locally clear. At least one light-emitting diode module is accommodated in the at least one recess and produces a light cone which lies completely within the interior.

18 Claims, 4 Drawing Sheets

REFRIGERATION APPLIANCE BODY COMPRISING INTERNAL LIGHTING

RELATED APPLICATIONS

This application claims benefit from, and priority to, each of Patent Cooperation Treaty Application Number PCT/EP2009/065137, filed Nov. 13, 2009, and German Patent Application 10 2008 044 302.6, filed Dec. 3, 2008.

BACKGROUND OF THE INVENTION

The present invention relates to a refrigeration appliance, in particular a domestic refrigerator, comprising a body and associated internal lighting. The internal lighting is designed to fulfill a plurality of disparate requirements. On the one hand, uniform illumination of the interior of the body over its entire height is required, even when the propagation of light in said interior is impaired by shelves and refrigerated items placed thereon; on the other hand, the illuminants used for the lighting must take up as little space as possible in the interior and also impart little heat thereto.

Powerful light-emitting diodes, particularly white emitting LEDs, which have been available for a number of years, offer the promise of ideally fulfilling these requirements. A refrigeration appliance in which light-emitting diodes are used for interior lighting is disclosed e.g. in DE 298 14 243 U1. This publication proposes accommodating light-emitting diodes in recesses in a side wall of the appliance body. Proposed mounting locations for the light-emitting diodes are, on the one hand, guide grooves in the side wall which are intended for accommodating and guiding glass shelves; alternatively, large-area recesses with LEDs can be disposed at the level of a compartment between two guide grooves, or a vertically elongated recess intersects the guide grooves. The light-emitting diodes disposed in the guide grooves essentially inject their light into the shelves. By essentially propagating therein by total internal reflection, the light can be distributed unobstructedly over the entire height and breadth of the interior, but only a small amount of light emerges from the shelves, so that the effectiveness of the lighting remains poor despite a theoretically good luminous efficacy. Moreover, the light essentially emerges from the shelves at locations where total internal reflection is disturbed, these being in practice mainly dirty locations. Any soiling of the shelves is therefore clearly visible, but the cleaner the shelves, the less light can reach the outside.

The light-emitting diodes accommodated in the large-area recesses do not have these disadvantages. In order to spread the light of said LEDs and achieve uniform lighting of the interior, it is proposed to seal the recesses with a diffuse pane in each case. Such a pane scatters the light in all directions, not only onto the refrigerated items, but also into the eyes of a user standing in front of the appliance. As the diffusing panes are much brighter than items illuminated thereby in the interior, it is difficult to avoid dazzling the user.

Published unexamined patent application JP 2008 070 080A shows a refrigeration appliance wherein a plurality of light-emitting diodes are disposed on side walls of the appliance in each case.

Published unexamined patent application JP 2008 073 153A shows a refrigeration appliance wherein a plurality of light-emitting diodes are disposed on side walls of the appliance in each case.

Published unexamined patent application JP 2008 039 359A shows a refrigeration appliance wherein a plurality of light-emitting diodes are mounted on side walls in each case. The light-emitting diodes are covered by means of a diffuse cover.

Published unexamined patent application JP 2006 336 985A shows a refrigerator having three lighting units in each case arranged on internal walls of the refrigerator in each case. The light-emitting diodes are covered by means of a diffuse cover.

BRIEF SUMMARY OF THE INVENTION

The object of the present invention is to create a refrigeration appliance with interior lighting wherein light lost on injection into the interior is minimized and dazzling of the user is at least largely eliminated.

In the case of a refrigeration appliance comprising a body with an interior enclosed by walls and an open front, wherein a recess sealed by a translucent pane is formed in a body wall extending from the front in the depth direction, said recess accommodating at least one light-emitting diode module, this object is achieved by said pane being at least locally clear and a light cone of said light-emitting diode module lying completely within the interior.

As a result of the light cone of the LED module being completely within the interior, a user standing in front of the body cannot directly see an emitting surface of an LED, thereby eliminating direct dazzling. Indirect dazzling from the translucent pane is eliminated insofar as, even where the latter is clear, it scatters no light in the direction of the viewer.

The pane is preferably essentially flush with the wall surface surrounding the recess in order not to interfere with the use of the interior.

The recess is preferably surrounded by an edge zone slightly sunken into the wall, into which zone the pane engages in a form-fit manner. This facilitates the mounting of the pane, as its position is clearly predefined by the position of the recesses in their edge zone.

According to an advantageous embodiment of the subject matter of the invention, the recess is provided on at least one of the lateral walls of the body, in particular in the vicinity of its open front, thereby resulting in particularly uniform lighting viewed in the depth direction of the body.

While conventionally the transparent covers of refrigerator internal lighting frequently have sharp edges, particularly on their inner sides facing the light source, in order to produce prisms, Fresnel lenses or other light refracting structures, with the body according to the invention a region of the pane transilluminated by the light cone is preferably without sharp edges, thus also reliably eliminating dazzle caused by light scattered by such edges.

In order to shape the light cone of the LED module in an expedient manner, the light-emitting diode can be surrounded by a reflector.

The recess in the wall of the body is preferably prism-shaped, i.e. triangular when viewed from above, a front side of the prism being adjacent to the open front of the body and a back side being closer to the back wall of the body. In order not to be directly visible to the user, the light-emitting diode is preferably disposed on the front side of the prism.

The recesses are preferably disposed on the front sides of the two lateral walls.

To help reduce the risk of dazzle and provide good lighting, particularly at the back of the interior, the front side of the prism is oriented at a greater angle to the pane than the back side.

With particular preference, the front side of the prism near the door and the back side include an obtuse intermediate angle.

In order to facilitate assembly, a plurality of light-emitting diode modules can be expediently accommodated in the same recess.

In order to minimize the depth of the recess, said plurality of light-emitting diode modules are expediently vertically staggered.

One or more recesses are particularly easy to produce if, according to a preferred embodiment of the invention, it is provided that the recess is implemented as so-called preformed inserts, i.e. as separate components, and inserted in appropriately dimensioned cutouts in the internal paneling of the interior, particularly inserted such that a thermal insulation material introduced into liquid initial components is prevented from escaping.

The recess can essentially extend over the height of the interior, or a plurality of vertically spaced recesses can be provided in the same wall.

Particularly in the latter case, the plurality of light-emitting diode modules of a same recess preferably have vertically fanned-out main beam directions in order to also illuminate a region of the interior above of below one of the recesses.

The front and back sides of the prism-shaped recess preferably include an obtuse intermediate angle.

BRIEF DESCRIPTION OF THE DRAWINGS

Further features and advantages of the invention will emerge from the following description of exemplary embodiments with reference to the accompanying drawings in which.

DETAILED DESCRIPTION OF EXEMPLARY EMBODIMENTS OF THE PRESENT INVENTION

Figure 1:
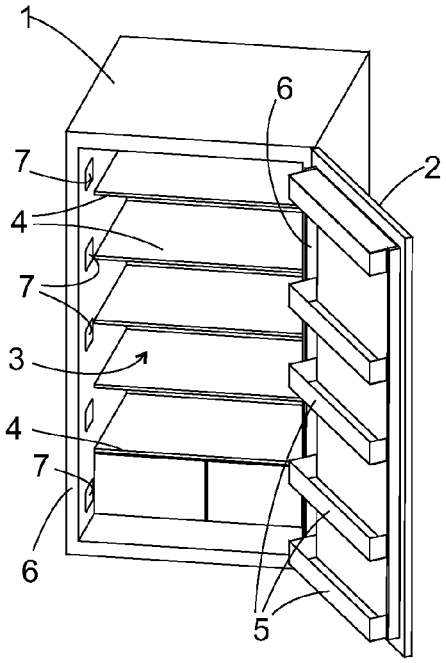
FIG. 1 shows a schematic view of a refrigeration appliance according to a first embodiment of the invention.

FIG. 1 shows a view of a refrigerator according to the invention, comprising a body 1 and a door 2 attached thereto. The interior 3 is subdivided into a plurality of compartments by shelves 4 for refrigerated items. The shelves 4 do not quite reach the open front of the body 1. In a region in front of the front edge of the shelves 4, in which region, with the door 2 closed, door trays 5 mounted to the inside thereof engage, there are formed on the side walls 6 of the body 1 a plurality of opposite pairs of recesses sealed in each case by a clear glass pane 7. The recesses are used to accommodate light-emitting diodes which emit light to the respective opposite side wall 6 and in the direction of the back wall of the body 1.

Figure 2:
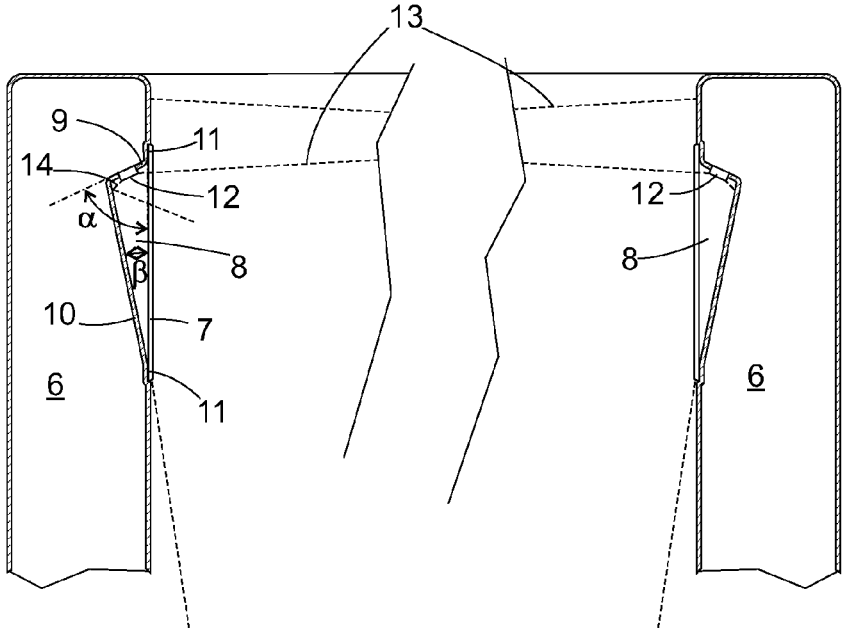
FIG. 2 shows a schematic horizontal section through a front region of the refrigeration appliance from FIG. 1

FIG. 2 shows a horizontal section through the front region of the side walls 6 with recesses 8 formed therein. The side walls 6 are implemented in per se known manner as hollow bodies filled with insulating foam. The recesses 8 each have the shape of an elongated triangle or prism with a front side 9 which spans an angle $\alpha$ ranging from 45 to 90°, preferably from 60 to 75°, with the glass pane 7 sealing the recess 8. The back side 10 of the recess forms with the glass pane 7 a much smaller angle $\beta$ ranging from 10 to 30°.

Formed around the prism-shaped recess 8 is a slightly sunken edge zone 11 in the side wall 6 into which the glass pane 7 is inserted in a form-fit manner. FIG. 2 shows the surface of the glass pane 7 facing the interior slightly projecting above the inner surface of the side wall 6; however, the depth of the edge zone 11 could also be exactly matched to the thickness of the glass pane 7 in order to achieve a completely flat, easy-to-wipe inner surface on the side wall 6.

The recess 8 can be thermoformed in one piece with the surrounding inner surface of the side wall 6, preferably in an operation involving the thermoforming, familiar per se to the average person skilled in the art, of an inner container integrally forming the inner surfaces of the side walls, of a back wall and of the top and base of the body. However, it is also possible to cut openings corresponding to the shape of the glass pane 7 in a thermoformed inner container of this kind, said openings being backed on the foam side with a shell forming the sides 9, 10. The use of such a shell—preferably metallic or mirrored—is particularly expedient if a highly reflective surface, especially of the back side 10 of the recess 8, is required. In addition, the use of a shell separate from the inner container offers the possibility of pre-mounting light-emitting diode modules 12 thereon prior to installing the shells in the body 1.

Figure 3:
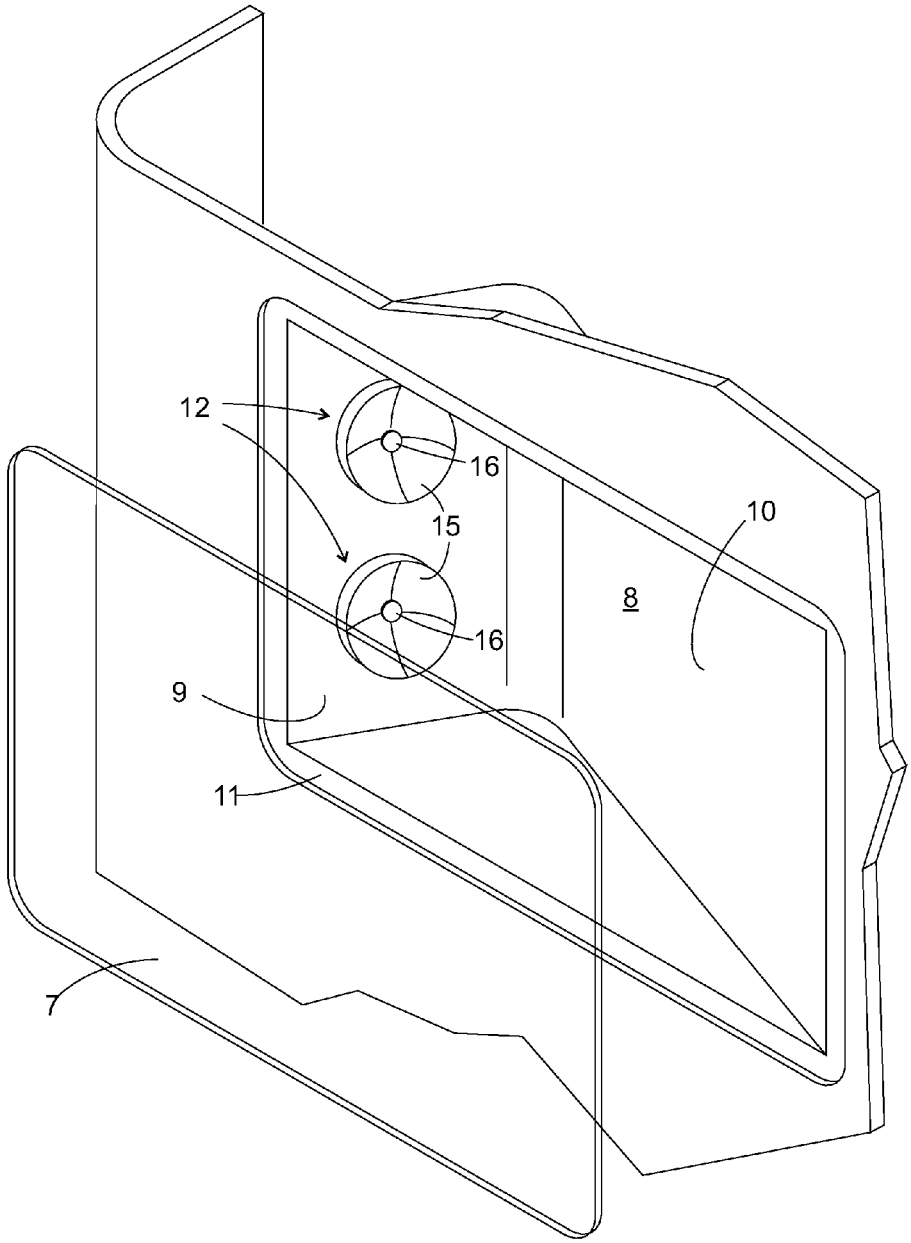
FIG. 3 shows a perspective, partially exploded view of a recess of the refrigeration appliance from FIG. 1.

Light-emitting diode modules 12 are disposed on the front side 9 of the recess 8, as shown in FIGS. 2 and 3. In the case of the inventively preferred light-emitting diode modules 12, a light-emitting diode 16 is combined with a spherical or parabolic reflector 15 to shape its beam (see FIG. 3). The reflector 15 is designed to produce a light cone, the edges of which are marked as dashed lines in FIG. 2. A front edge of the light cone, denoted by 13, runs essentially perpendicular to the side walls 6 or at the most, as shown in the Figure, is angled slightly forward, so that the light of the module 12 is completely incident on the opposite side wall 6. An opposite edge 14 of the light cone strikes the back side 10 of the recess and is thereby reflected deep into the interior 3.

The glass pane 7 is clear and flat on both surfaces so that no scattering centers are formed. The pane 7 does not therefore appear bright when light from the light-emitting diode 16 shines through it. As it reflects, the back side 10 also does not appear bright to a user standing in front of the appliance. Dazzling is thus reliably eliminated.

FIG. 3 shows a perspective view of an inner container fragment with the recess 8 formed therein and the glass pane 7 to be mounted in front of the recess 8, viewed from the back wall of the interior 3. Mounted on the front side 9 of the recess 8 are mounted two LED modules 12 having a central light-emitting diode 16 and a reflector 15 enclosing it and shaping its beam. The main beam directions of the two modules 12 run essentially horizontally; they can easily diverge upward and downward in order to evenly illumination regions of the interior 3 located above or below the recess 8.

Figure 4:
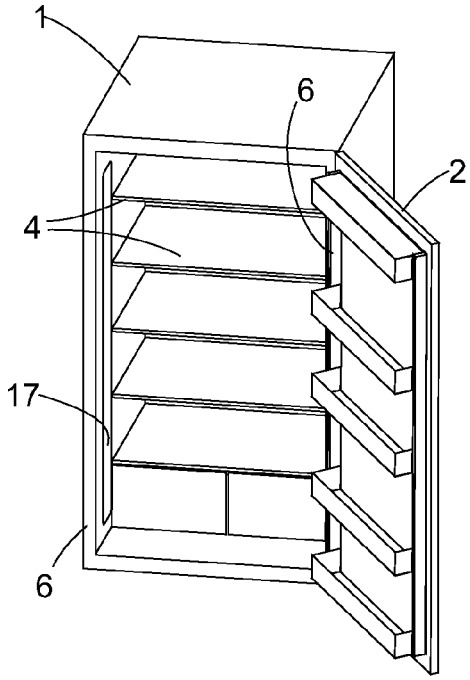
FIG. 4 shows a view similar to FIG. 1 according to a second embodiment of the invention.

A second embodiment of the invention is shown in FIG. 4 in a perspective view similar to FIG. 1. Here the plurality of recesses 8 on each side wall 6 are merged into a recess 17 extending essentially over the entire height of the interior 3. Disposed in said recess 17 is in each case a plurality of light-emitting diode modules of the type shown in FIG. 3 in a row one above the other on the narrow front side of the recess.

Figure 5:
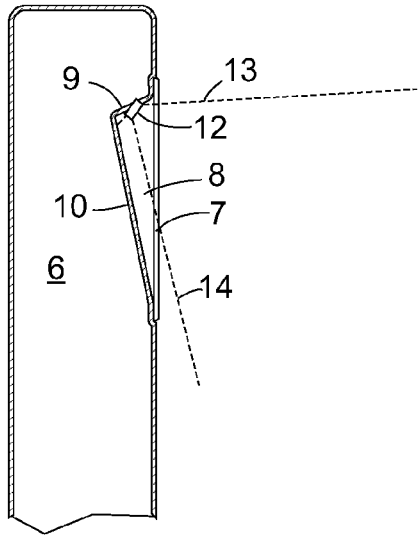
FIG. 5 shows a section through the front region of a side wall according to a third embodiment of the invention.

Using the surrounding reflectors 15, the beam of a light-emitting diode is largely shapeable as required. While in the arrangement in FIG. 2 the main beam direction of the light-emitting diode module 12 on the front side 9 of the recess 8 is perpendicular, an arrangement with main beam direction oriented obliquely to the front side 9 and smaller beam angle of the light cone is also conceivable. Thus, for example, as shown in FIG. 5, the beam cone of the LED module 12 disposed obliquely to the front side 9 is designed such that the back side 10 is essentially illuminated only by light reflected by the glass pane 7 and does not therefore appear excessively bright even if it does not reflect.

Figure 6:
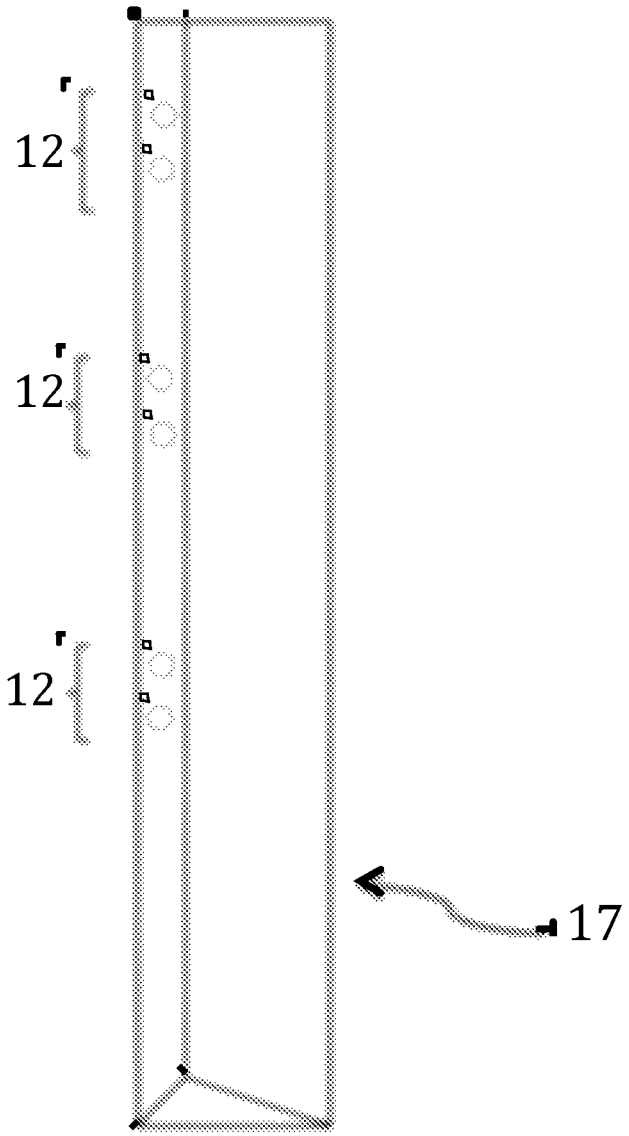
FIG. 6 shows a schematic view of a plurality of light-emitting diode modules that are vertically staggered and accommodated in at least one recess.

FIG. 6 shows a schematic view of the light-emitting diode arrangement exemplified by FIG. 4, for instance. As shown in FIG. 6, a plurality of light-emitting diode modules 12 are vertically staggered and accommodated in at least one recess 17. While one recess 17 is shown, additional embodiments of the invention, for instance as shown in the embodiment of the invention exemplified in FIG. 1, may include additional recesses such as those sealed by clear pane 7, which are vertically staggered and accommodated in multiple recesses.

The invention claimed is:

1. A refrigeration appliance, comprising:

a body having walls to define an interior with an open front side, one of the walls extending from the front side of the body in a depth direction and formed with at least one recess;

a translucent pane sealing the at least one recess, said pane being at least locally clear; and at least one light-emitting diode module accommodated in the at least one recess and producing a light cone which lies completely within the interior.

2. The refrigeration appliance of claim 1, constructed in the form of a domestic refrigerator.

3. The refrigeration appliance of claim 1, wherein the pane is flush with a surface of the one of the walls surrounding the at least one recess.

4. The refrigeration appliance of claim 1, wherein the pane engages in a form-fit manner in a circumferential flat edge zone of the at least one recess.

5. The refrigeration appliance of claim 1, wherein the pane has a region which is transilluminated by the light cone and devoid of sharp edges.

6. The refrigeration appliance of claim 1, wherein the light-emitting diode module comprises a light-emitting diode and a reflector surrounding the light-emitting diode.

7. The refrigeration appliance of claim 1, wherein the at least one recess has a cross section in the shape of a prism, said light-emitting diode module being disposed on a front side of the prism.

8. The refrigeration appliance of claim 7, wherein the front side of the prism is oriented at a greater intermediate angle in relation to the pane than a back side thereof.

9. The refrigeration appliance of claim 7, wherein the front side and the back side include an obtuse intermediate angle.

10. The refrigeration appliance of claim 1, wherein the one of the walls is a lateral wall of the body.

11. The refrigeration appliance of claim 10, wherein the at least one recess is disposed in the lateral wall in a vicinity of the front side.

12. The refrigeration appliance of claim 1, wherein a plurality of light-emitting diode modules are accommodated in the at least one recess.

13. The refrigeration appliance of claim 12, wherein the plurality of light-emitting diode modules are vertically staggered.

14. The refrigeration appliance of claim 1, wherein the at least one recess extends over a height of the interior.

15. The refrigeration appliance of claim 1, wherein the one of the walls includes a plurality of recesses in vertically spaced-apart relationship.

16. The refrigeration appliance of claim 12, wherein the plurality of light-emitting modules have vertically fanned-out main beam directions.

17. The refrigeration appliance of claim 1, further comprising an internal panel lining the interior, said at least one recess being part of a separate component which is insertable in a seating in the internal panel in a foam-tight manner.

18. The refrigeration appliance of claim 1, wherein the one of the walls and another opposite one of the walls are each formed with at least one said recess in a vicinity of the front side of the body.

* * * * *

UNITED STATES PATENT AND TRADEMARK OFFICE

CERTIFICATE OF CORRECTION

PATENT NO. : 8,459,818 B2
APPLICATION NO. : 13/130313
DATED : June 11, 2013
INVENTOR(S) : Becke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 140 days.

Signed and Sealed this
Eighth Day of September, 2015

Michelle K. Lee

Michelle K. Lee
*Director of the United States Patent and Trademark Office*